United States Patent [19]

Hauschopp

[11] Patent Number: 4,505,518

[45] Date of Patent: Mar. 19, 1985

[54] MINERAL WINNING MACHINES

[75] Inventor: Alois Hauschopp, Werne, Fed. Rep. of Germany

[73] Assignee: Gewerkschaft Eisenhutte Westfalia, Lunen, Fed. Rep. of Germany

[21] Appl. No.: 508,757

[22] Filed: Jun. 28, 1983

[30] Foreign Application Priority Data

Jul. 6, 1982 [DE] Fed. Rep. of Germany ..... 3225181

[51] Int. Cl.[3] ..... E21C 27/32

[52] U.S. Cl. ..... 299/34; 299/80; 74/526; 74/527

[58] Field of Search ..... 299/34, 71, 76, 80; 175/273, 342, 279; 292/177, 181, 175, 174; 74/526, 527

[56] References Cited

U.S. PATENT DOCUMENTS

| | | | |
|---|---|---|---|
| 2,871,721 | 2/1959 | Abramoska et al. | 74/527 |
| 3,517,570 | 6/1970 | Kolb | 74/527 |
| 3,877,752 | 4/1975 | Hauschopp et al. | 299/34 |
| 3,965,755 | 6/1976 | Rosenberg et al. | 74/527 |
| 4,069,723 | 1/1978 | Payerle | 74/527 |
| 4,199,194 | 4/1980 | Steinkuhl et al. | 299/80 |

FOREIGN PATENT DOCUMENTS

| | | | |
|---|---|---|---|
| 6713259 | of 1967 | Netherlands | 299/34 |

*Primary Examiner*—Stephen J. Novosad
*Assistant Examiner*—Mark J. DelSignore
*Attorney, Agent, or Firm*—Sughrue, Mion, Zinn, Macpeak and Seas

[57] ABSTRACT

A mineral winning machine in the form of a coal plough has adjustable floor cutters. To set the floor cutters at different heights use is made of arcuate levers as carriers for the floor cutters which are slidably guided as known per se. Eccentric stop members engage on the upper ends of the levers and are rotatable to bring different faces into engagement with the levers. Locking means holds each stop member in its rotational setting and the locking means can be released for re-setting by axial displacement of the stop member against a spring force.

8 Claims, 8 Drawing Figures

1
2
3
4
5
6
7
8
9
10
14
33

1
2
3
4
5
17
19
32
33
34

FIG. 6
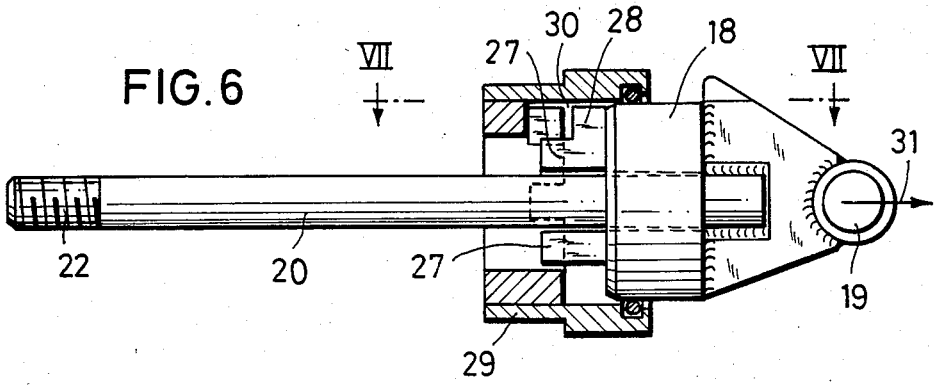
FIG. 7
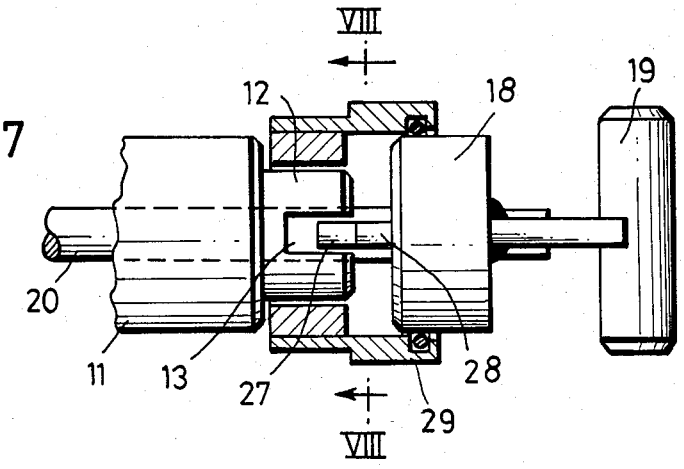
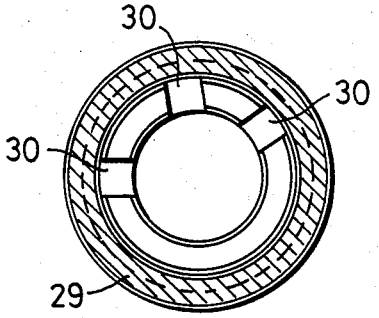
FIG. 8

MINERAL WINNING MACHINES

BACKGROUND TO THE INVENTION

The present invention relates in general to mineral winning machines or coal ploughs and, more particularly, to arrangements for adjusting the position of floor cutters thereof.

In order to adjust the position of cutters of a plough it is known to mount the cutters on a pivotable carrier and to engage the carrier with an eccentric stop or cam rotatable with the aid of a shaft accessible from the goaf side of the plough. German patent specification No. 1239258 describes an arrangement of this type. It is also known to mount the floor cutters of a plough on rocker levers of arcuate shape which are guided by appropriately shaped guideways. U.S. Pat. No. 3,877,752 describes an arrangement of this type. In this known construction the levers or carriers are locked in set positions by means of cotter pins inserted into aligned bores in the levers and the plough body. The present invention is concerned with an adjustment arrangement of the type generally described in U.S. Pat. No. 3,877,752 and seeks to provide an improved construction.

SUMMARY OF THE INVENTION

In one aspect, the present invention provides an arrangement for adjusting the position of a cutter or tool carrier of a mineral winning machine which comprises an eccentric stop member with a plurality of working faces selectively engageable with said carrier, a shaft supported for rotation on the body of the machine and carrying the stop member and spring-loaded locking means for locking the stop member in a set position corresponding to one of the working faces, the locking means being releasable to permit re-setting by axial movement of the shaft against the spring loading force. Such an arrangement can function most reliably even in the harsh conditions encountered in coal mining and the arrangement is robust and less susceptible to soiling and damage than arrangements known in the past. The arrangement can moreover be accommodated on the machine quite easily without taking up much space which is especially advantageous with machines or ploughs of short overall length.

In a preferred construction a coupling piece or setting member conveniently provided with handle or the like accessible at the goaf side of the machine or plough is connected to the shaft with the aid of connecting means permitting relative axial movement while maintaining the shaft locked for rotation to the coupling piece. The locking means can take the form of complementary projection(s) and recess(es) between the coupling piece and some fixed structure such as a bearing bushing fitted in a bore in the body of the plough. To re-adjust the carrier it is necessary simply to cause axial displacement between the coupling piece and the shaft sufficient to release, say, one projection from one of the recesses. Conveniently this release is achieved by withdrawing the coupling piece outwardly by traction on the handle but it is feasible to force the coupling piece inwardly by thrust. In the former case the coupling piece can be fitted to a draw rod extending through the shaft and a compression spring at the opposite end and can then act on the draw rod to bias the coupling piece inwardly of the bush. The compression spring can surround the draw rod and seat in a recess in the stop member. A nut engaged on the draw rod can then be acted on by the spring. The spring acts to restore the system automatically to lock the stop member in a set position.

The connecting means between the shaft and the coupling piece can be in the form of one or more axial projections on the coupling piece engaging in a slot, for example, in a journal of the shaft fitting in the bearing bushing. The projection of the locking means can then be a single radial projection on the coupling piece engageable in one of several recesses in the bushing. By making the axial dimension of the axial projection(s) larger than that of the radial projections the shaft and coupling piece can be maintained locked for mutual rotation even when the locking means is released.

Especially where the plough itself has a short overall length, it is desirable to provide a further stop member which is rotatably supported on the plough body and engages the carrier when the main stop member is adjusted to a predetermined position. The further stop member can be a simple bolt which is subjected to its own locking arrangement. This supplementary stop member makes it possible to reduce the size of the main eccentric stop member which is advantageous with small ploughs.

In a preferred construction the plough has floor cutters supported by symmetrical arcuate carriers each having an adjustment arrangement in accordance with the invention. As the plough moves back and forth along the face each carrier is re-adjusted accordingly. The eccentric stop members associated with the carriers can be disposed close together with their outer paths of movement intersecting to reduce the space needed. Nevertheless, by making the eccentric members rotatable in opposite directions they can be adjusted independently.

In another aspect the invention provides a coal plough comprising a body equipped with sets of cutter bits, floor cutter mounted on arcuate carriers displaceable to adjust the height of the floor cutters, a pair of shafts rotatably supported by the body, an eccentric stop member mounted on each shaft for engagement with a respective one of said carriers to effect said adjustment, each stop member having a plurality of working faces each of which engages the associated carrier as the associated shaft is rotated and releasable spring-loaded locking means for holding the stop members in set positions corresponding to the working faces; wherein the working faces of the eccentric stop members disposed at the greatest distance from the axis of the associated shaft lie on rotational paths which intersect one another and the stop members are rendered movable in opposite rotational directions to bring their working faces into engagement with the respective carriers independently of one another.

The invention may be understood more readily, and various other aspects and features of the invention may become apparent, from consideration of the following description.

BRIEF DESCRIPTION OF DRAWING

An embodiment of the invention will now be described, by way of example only, with reference to the accompanying drawings, wherein:

FIG. 6 is a part-sectional elevation of further components of the adjustment device of FIG. 3;

FIG. 7 is a sectional plan view of the components of FIG. 6, the view being taken along the line VII—VII of FIG. 6; and FIG. 8 is a sectional end view of the components of FIG. 6, the view being taken along the line VIII—VIII of FIG. 6.

DESCRIPTION OF PREFERRED EMBODIMENT

Figure 1:
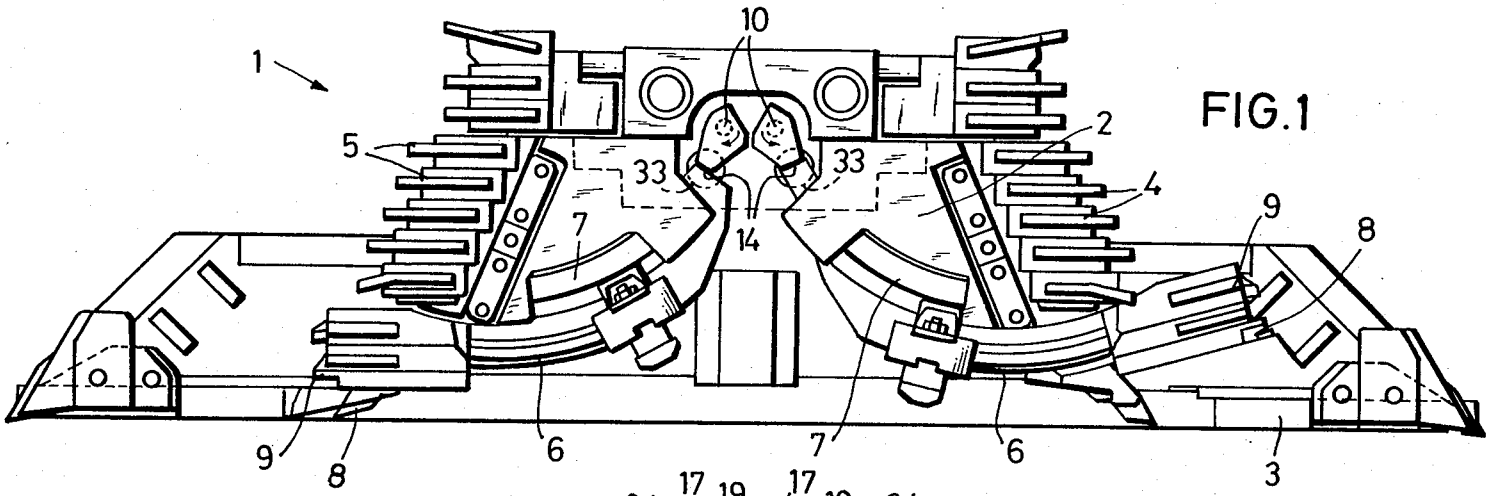
FIG. 1 is a front view of an mineral winning machine constructed in accordance with the invention.
Figure 2:
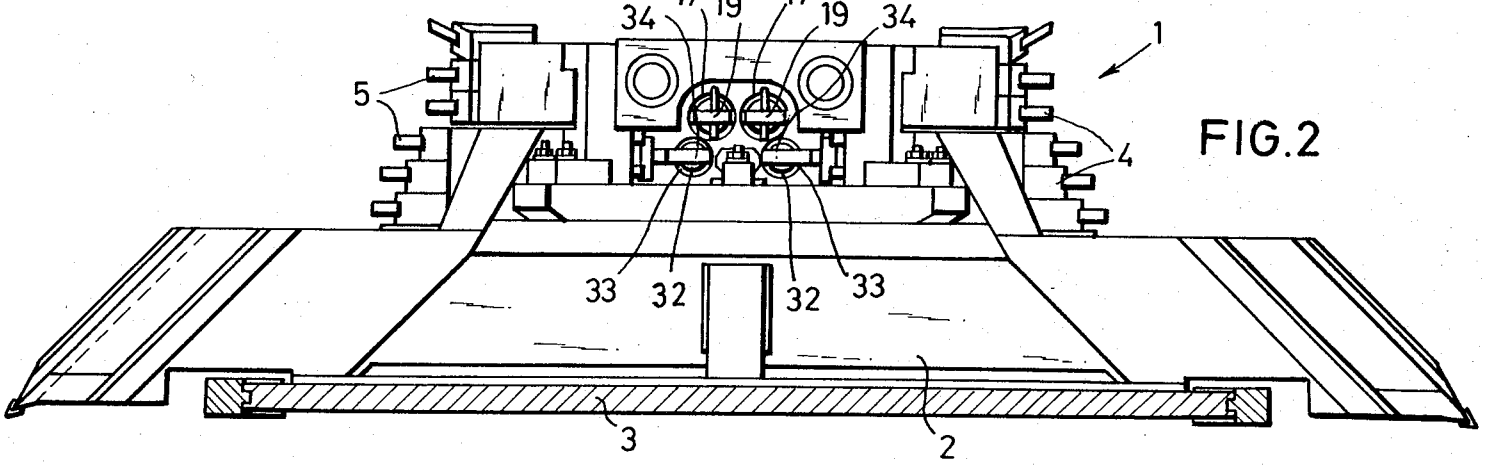
FIG. 2 is a rear view of the mineral winning machine shown in FIG. 1.
Figure 3:
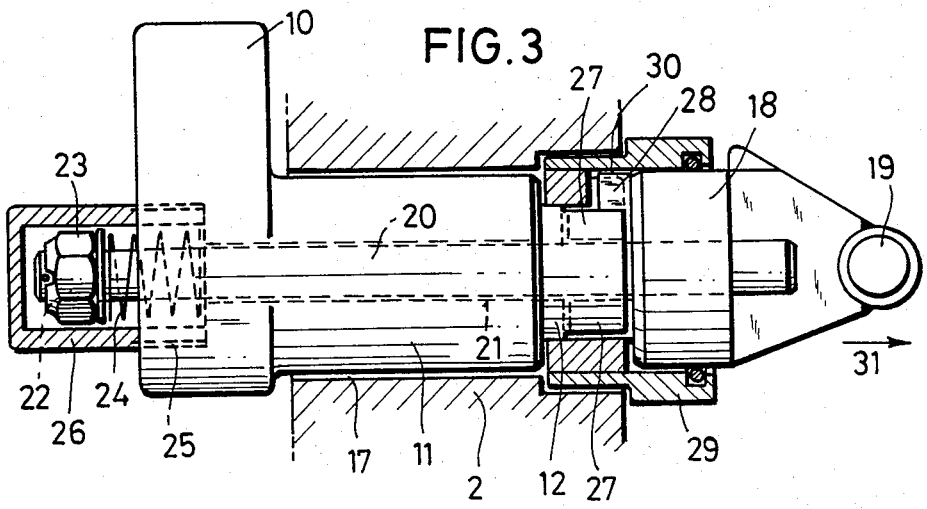
FIG. 3 is a part-sectional end view of part of the machine taken on a somewhat larger scale and showing an adjustment device thereof in elevation.
Figure 4:
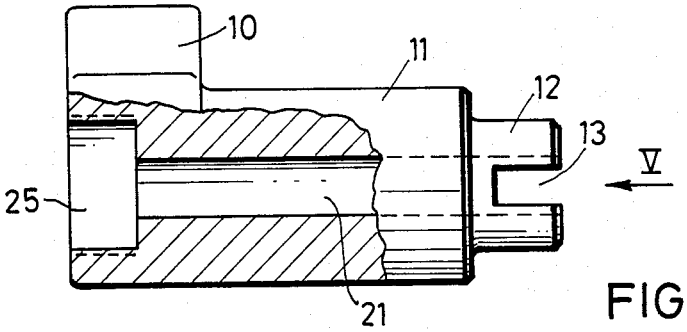
FIG. 4 is a part-sectional elevation of one component of the adjustment device shown in FIG. 3.

A mineral mining machine or plough for winning mineral ore, especially coal, is shown in FIGS. 1 and 2. The plough, designated 1 is of generally known construction and is composed of a main central body 2 coupled to a one-piece sword plate 3 which engages beneath a conveyor (not shown) extending alongside the mineral face of a working. A drive chain disposed at the goaf side of the conveyor would be connected to the sword plate 3 and would serve to propel the plough 1 back and forth along the conveyor. Guide means is provided to guide the plough 1 for such movement.

The body 2 of the plough is relatively short and carries sets of symmetrical staggered cutter bits 4, 5 at its ends for stripping mineral from the face as is known. The body 2 also has arcuate guides 7 which slidably receive carriers in the form of rocker levers 6. One or more floor cutters 8, 9 are mounted on the carriers 6. The carriers 6 are adjusted with the aid of adjustment devices, described hereinafter, to bring the floor cutters 8, 9 into working or non-working positions. During operation, the carrier 6 at the forward end of the plough 1 relative to its direction of movement would be adjusted to bring the lower floor cutter 8 into a desired cutting position while the carrier 6 at the rear end would be adjusted to bring the floor cutter 8 away from the floor so as to perform no cutting work. The adjustment of the position of the lower floor cutters 8 determines the overall cutting position of the plough. When the plough reverses its direction of travel the carriers 6 would be readjusted accordingly. As shown in FIGS. 1 and 2, the arrangement which serves to adjust the position of the carriers 6 and hence the position of the floor cutters 8, 9 takes the form of devices with eccentric cam or stop members 10 mounted for rotation on the body 2. The upper ends of the carriers 6 abut on the associated members 10 and the rotational position of the stop members 10 thus determines the position of the floor cutters 8, 9. The cam or stop members 10 are disposed within a recess in the body 2 and close together so that outermost paths of motion of the stop members 10 intersect one another.

Figure 5:
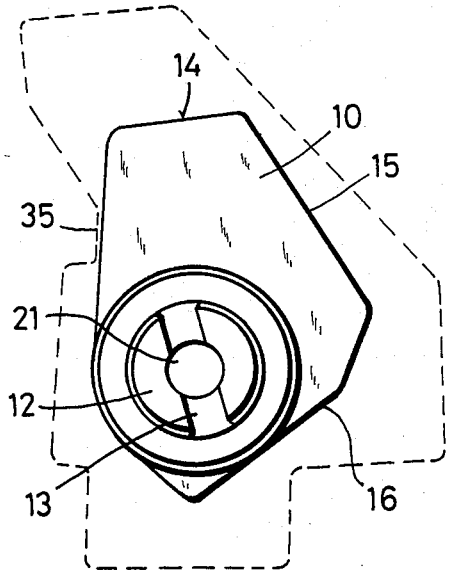
FIG. 5 is an end view of the component of FIG. 4, the view being taken in the direction of arrow V in FIG. 4.

The construction of one of the adjustment devices is shown in more detail in FIGS. 3 to 8. Each stop member 10 is formed integrally or otherwise with a hollow shaft 11 provided with a stepped journal end portion 12. This end portion 12 is provided with a transverse slot 13. The plough body 2 has two parallel horizontal bores 17 for receiving the shafts 11. As shown in FIG. 5, the stop member 10 itself has a number of angularly offset rectilinear stop faces 14, 15 and 16 for engagement with the associated lever 6. The stop face 14 is disposed at the greatest distance from the axis of motion of the shaft 11 and when engaged with the associated lever 6 brings the floor cutter 8 to its highest level whereas the stop face 16 disposed at the shortest distance from the axis of the shaft 11 will act on the lever 6 to bring the floor cutter 8 to its lowest position. The third stop face 15 provides an intermediate position for the floor cutter 8.

The rotational displacement of each of the shafts 11 is effected from the goaf side of the plough 1 by way of a setting member or coupling piece 18 provided with a handle 19. The coupling piece 18 has a draw rod 20 which extends through an axial bore 21 in the shaft 11 and the stop member 10. The rod 20 has a threaded end portion 22 which receives a nut 23. A helical spring 24 surrounds the rod 20 and engages in a recess 25 in the stop member 10 coaxial with the bore 21. The outer end of the spring 24 bears on a washer beneath the nut 23. A protective cap 26 engages in the bore 25 as a push fit or a threaded connection to surround the nut 23, the washer and the spring 24. The coupling piece 18 is connected for rotation with the shaft 11 but is axially displaceable in relation to the shaft 11. For this purpose the coupling piece 18 is provided with a pair of axial projections or noses 27 which engage in the slot 13 at the end part 12 of the shaft 11. A further radial projection 28 engages in one of several apertures 30 in a bearing bushing 29 provided in one of the bores 17 in the body 2. The bushing 29 locates the coupling piece 18 and the shaft 11 for rotation and an O-ring mounted in the bushing 29 engages in the coupling piece 18 as shown in FIG. 6. Each bushing 29 has three apertures 30, offset in relation to one another in the circumferential direction to bring the stop member 10 into one of the three alternative positions corresponding to the faces 14, 15, 16. In order to bring the stop member 10 into another adjustment position, whereby to alter the position of the associated floor cutter 8, the coupling piece 18 is drawn outwardly by means of the handle 19 against the return force of the spring 24 in the direction of arrow 31 (FIGS. 3 and 6) to bring the projection 28 out of the locking position of FIG. 3 and into a free position shown in FIGS. 6 and 7 to permit rotation to occur. By rotating the handle 19 the coupling piece 18 can be made to pivot the shaft 11 via the connection 13, 27 to bring another stop face of the stop member 10 against the associated lever 6. Upon release of the handle 19, the member 18 is drawn inwards by the restoring force of the spring 24 to bring the projection 28 into the relevant aperture 30 to lock the adjustment device in the selected position. The axial length of the projection 27 is greater than that of the projection 28 so that the coupling member 18 is maintained rotationally locked to the shaft 11 when the projection 28 is released by pulling the handle 19 in the direction of arrow 31. The stop members 10 are rendered rotatable in opposite directions to one another from their positions as shown in FIG. 5 and in which the stop face 16 forms the stop for the associated carrier 6 since the rotational movement in the other direction is blocked by an abutment 35 on the plough body 2. This allows the stop members 10 to be disposed close to one another in positions where their faces 14 could interfere if they were not constrained to rotate in opposite directions.

As shown in FIG. 2, in addition to the stop members 10, further stop members 32 are provided to permit the floor cutters 8 to adopt a fourth setting position. Each stop member 32 is a simple bolt located in a bore 33 in the plough body 2 for axial and stational movement.

The bores 33 extend parallel to the bores 17 which accommodate the shafts 11 and the bores 33 are offset downwards and laterally outwardly in relation to the bores 17 so that the stop members 32 engage the levers 6 in positions in which the floor cutters 8 are set to the highest level. In order to bring the stop members 32 into their working positions, the associated stop members 10 must be adjusted with the aid of the setting device as described above to ensure that the stop members 10 do not project over the bores 33 and interfere with the stop members 32. The stop members 32 are securable in axially retracted and extended positions by a disengagable locking system, for example, spring elements 34, detents or the like.

I claim:

1. In a mineral winning machine having a body (2) equipped with cutters, some of which (8, 9) are mounted on adjustable carriers (6); an improved arrangement for adjusting the position of said carriers, said arrangement comprising: an eccentric stop member (10) with a plurality of working faces (14, 15, 16) selectively engageable with an associated adjustable carrier to define set positions of the carrier relative to the body, a shaft (11) rotationally supported on said body and carrying the stop member, a coupling piece (18) provided with a manually-operable handle (19), locking means in the form of complementary interengageable projections (28) and recesses (30) operably disposed between the coupling piece and a fixed structure (29) for locking the coupling piece in set rotational positions corresponding to the working faces of the stop member, connecting means (13, 27) disposed between the shaft and the coupling piece for permitting the shaft and coupling piece to move relative to one another axially of the shaft to release the locking means while maintaining the shaft rotationally locked to the coupling piece for rotation with the handle, and a spring (24) for biasing the coupling piece to cause the locking means to lock the coupling piece to the fixed structure in one of said set positions; the coupling piece being axially displaceable relative to the shaft with the aid of the handle against the force of the spring to disengage the locking means and permit rotation of the shaft through the coupling piece and connecting means to permit partial rotation of the stop member and re-setting of the carrier.

2. An arrangement according to claim 1, wherein the fixed structure is a bearing bushing (29) in which the coupling piece is received, and the locking means is formed by a projection (28) on the coupling piece and several complementary recesses (30) in the bushing at circumferential spacings corresponding to the working faces.

3. An arrangement according to claim 1, wherein the shaft is hollow and the coupling piece is fitted to a draw rod (20) extending through the shaft, and said spring-loading is provided by a compression spring (24) acting on the end of the draw rod remote from the coupling piece.

4. An arrangement according to claim 1, wherein the connection means between the shaft and the coupling piece comprises a slotted (13) end portion (12) of the shaft which receives a projecting part (27) of the coupling piece.

5. An arrangement according to claim 2, wherein the projection (28) of the coupling piece (18) which forms part of the locking means extends radially of the coupling piece, and the connection means between the shaft and the coupling piece is composed of a slot (13) in the end (12) of the shaft which receives at least one axial projection (27) of the coupling piece, the axial projection having an axial length greater than the radial projection to maintain the shaft rotationally locked to the coupling piece when the radial projection is released from one of the complementary recesses.

6. An arrangement according to claim 3, wherein the compression spring locates in a recess (25) in the eccentric stop member and the draw rod extends through the spring and has a threaded end portion (22) receiving a nut (23) against which the spring bears to provide the spring loading force.

7. An arrangement according to claim 1, further comprising another separate stop member (32) rotationally supported on said body and operably engageable with the associated carrier when the first-mentioned stop member is adjusted to a pre-determined position.

8. A coal plough, comprising: a body (2) equipped with sets of cutter bits (4, 5), floor cutters (8, 9) mounted on arcuate carriers (6) displaceable to adjust the height of the floor cutters, a pair of shafts (11) rotatably supported by the body, an eccentric stop member (10) mounted on each shaft for engagement with a respective one of said carriers to effect said adjustment, each stop member having a plurality of working faces (14, 15, 16) each of which engages the associated carrier as the associated shaft is rotated, and releasable spring-loaded (24) locking means (28–30) for maintaining the stop members in set positions corresponding to the working faces; wherein the working faces of the eccentric stop members disposed at the greatest distance from the axis of the associated shaft lie on rotational paths which intersect one another, and means (35) for rendering the stop members movable in opposite rotational directions to bring their working faces into engagement with the respective carriers independently of one another.

* * * * *